US006712198B2

(12) United States Patent
Harsch et al.

(10) Patent No.: US 6,712,198 B2
(45) Date of Patent: Mar. 30, 2004

(54) ARTICULATED ARM TRANSPORT SYSTEM

(75) Inventors: Erich Harsch, Weingarten (DE); Rainer Reichenbach, Schlier (DE)

(73) Assignee: Müller Weingarten AG, Weingarten (DE)

( * ) Notice: Subject to any disclaimer, the term of this patent is extended or adjusted under 35 U.S.C. 154(b) by 0 days.

(21) Appl. No.: 10/129,011

(22) PCT Filed: Aug. 10, 2001

(86) PCT No.: PCT/DE01/03083

§ 371 (c)(1),
(2), (4) Date: May 1, 2002

(87) PCT Pub. No.: WO02/18073

PCT Pub. Date: Mar. 7, 2002

(65) Prior Publication Data

US 2002/0192058 A1 Dec. 19, 2002

(30) Foreign Application Priority Data

Sep. 1, 2000 (DE) ..... 100 42 991

(51) Int. Cl.[7] ..... B65G 25/04; B66C 1/00; B66C 3/00; B25J 11/00

(52) U.S. Cl. ..... 198/750.11; 198/750.12; 414/732; 414/733; 901/21

(58) Field of Search ..... 198/750.11, 750.12; 414/732, 733, 917; 901/21, 23

(56) References Cited

U.S. PATENT DOCUMENTS

| | | | | |
|---|---|---|---|---|
| 4,056,198 | A | * 11/1977 | Boserup | 414/733 |
| 4,299,533 | A | * 11/1981 | Ohnaka | 198/750.12 |
| 4,396,344 | A | * 8/1983 | Sugimoto et al. | 901/21 |
| 4,507,046 | A | * 3/1985 | Sugimoto et al. | 414/735 |
| 4,548,544 | A | * 10/1985 | Van Appledorn | 198/750.11 |
| 5,222,409 | A | * 6/1993 | Dalakian | 414/733 |
| 5,423,648 | A | 6/1995 | Akeel et al. | |
| 5,584,205 | A | 12/1996 | Harsch et al. | |
| 5,842,370 | A | 12/1998 | Hofele et al. | |

FOREIGN PATENT DOCUMENTS

| | | |
|---|---|---|
| DE | 19654475 A1 | 7/1998 |
| DE | 10010079 A1 | 9/2000 |
| EP | 0672480 B1 | 10/1997 |

* cited by examiner

*Primary Examiner*—Gene O. Crawford
(74) *Attorney, Agent, or Firm*—Venable LLP; Robert Kinberg

(57) ABSTRACT

An articulated-arm transport system, provided in particular for the automation of press lines and large-component transfer presses, is distinguished by a design which permits components or workpieces to be inserted or removed even when there is a small clearance between an upper and lower tool.

10 Claims, 7 Drawing Sheets

ARTICULATED ARM TRANSPORT SYSTEM

The invention relates to a transport system for transporting workpieces from a machining station into the next machining station or intermediate store of a press, press line, simulator, or the like.

PRIOR ART

Where the manufacture of a workpiece calls for a plurality of work operations, such as cutting or shaping, then for economic production the necessary individual operations are carried out in a transfer press or press line, as they are known. The number of tools then corresponds to the number of work stages which are necessary for the manufacture. In the presses there are transport devices with which the workpieces are transported from one workstation to the next.

In the case of transfer presses or large-component transfer presses, the transport devices comprise gripper or load bearing rails which extend through the entire length of the shaping machine. In order to transport the components, the load bearing rails are fitted with gripper or holding elements. In this case, a distinction is made, depending on the movement sequence, between a two-axis transfer fitted with suction crossmembers or a three-axis transfer fitted with gripper elements. As an additional movement, pivoting in order to change the attitude of the component during the transport step may be required. This attitude change can also be carried out by an orientation station arranged between the shaping stages.

The transfer movement is initiated via cams, which are forcibly synchronized with the ram drive via movement transmission elements. The manufacture of large-area components, in particular, has led to the development of large-component transfer presses of greater and greater dimensions, based on the shaping force and the transport paths. Tool spacings of the order of magnitude of 5000 mm are entirely normal nowadays, and therefore corresponding transport steps are also necessary.

As a result of this development, the masses to be accelerated and braked in the transfer systems are completely opposed to the low masses of the components to be transported. Since the transport step is to be executed in an extremely short time, in order to achieve the greatest possible number of press strokes and therefore output of components, the system must have a high speed and therefore also acceleration and retardation.

A further disadvantage is the rigid movement sequence which is predefined by the cam drives. The optimum utilization of the free spaces between the lower and upper tool during the ram stroke to transport the parts is not possible.

In order to avoid these indicated disadvantages, intellectual rights applications nowadays concern the replacement of the previous transfer system by a corresponding number of transfer systems arranged between the machining stages and equipped with their own drive. Such an arrangement is disclosed by EP 0 672 480 B1. Transfer systems arranged on the uprights are equipped with a number of drives which, in operative connection with the movement transmission means, carry out the transport of the components. As a special feature, the system can be re-equipped both as a two-axis transfer with suction beams and as a three-axis transfer with grippers. However, this universal use requires a corresponding outlay on construction.

Likewise arranged in each upright area is a transfer device disclosed by DE 196 544 75 A1. In this application, elements which are known as—parallel cinematics—are used for the drive. In a modification of these known movement elements, however, telescopic lengthening of the drive rods is not performed, but, with a constant rod length, the attachment points are changed and therefore the transport movements are achieved. The attachment points that accommodate the forces or torques are not constant in terms of their distance from one another and, in particular when these points are close to one another because of the desired travel curve, support problems can occur. In order to increase the stiffness of the system, further mutually parallel links are also proposed, which are connected to one another by transverse crossmembers. In order to achieve functionally reliable transport of large-area components, the proposed system becomes correspondingly complicated and has a large overall height.

In DE 100 10 079, not previously published, the applicant proposes a system having transport devices arranged in the press upright area, which operate in a way comparable with a pivoting-arm principle. Crossmembers which are provided with component pick-up and holding means and are arranged transversely with respect to the transport direction are in each case held and moved at their ends by these pivoting-arm robots. Thus, the pivoting-arm robots are in each case arranged in pairs and opposite each other in the upright area. Because of the overall height and the vertical movement required by the drive concept, the transport system proposed is in particular suitable for presses with a relatively large overall height. The pivoting arm comprises a rigid piece which results in a correspondingly large pivoting radius. Since the intention is for the workpieces to be removed at the earliest possible time after the start of the ram upward movement, the large pivoting radius and the resulting obstructing edges are unfavorable. With this system, a desirable flat entry or exit curve can be implemented only with difficulty.

OBJECT AND ADVANTAGE OF THE INVENTION

The invention is based on the object of providing a highly flexible and precise transport system with a low overall height which ensures advantageous utilization of the free movement between the upper and lower tool for the purpose of insertion and removal of workpieces.

The invention is based on the idea, instead of using a rigid transport system, to design the latter from two parts which are connected to each other, mounted in an articulated fashion. In order to achieve a flat entry and exit curve, the pivoting angle of the first part arm can be selected to appropriately large.

On the basis of the proposed design, in conjunction with controlled drives, the pivoting angle can be selected within any technically practical range. As a result, in the tool area the transport arm is located in a very flat attitude oriented toward the horizontal plane.

Thus, with a relatively small opening stroke of the press ram bearing the upper tool, the articulated arm can advantageously move into the clearance which forms between the upper and lower tool.

Particularly advantageous is a design of the two articulated arm parts with equal lengths, since then a horizontal transport movement is executed. The suction spider carrying the workpiece therefore carries out a distortion-free horizontal movement. The vertical movement necessary to deposit and raise the workpieces is executed by a stationary lifting drive.

Given superimposition of the horizontal and the vertical movements, an appropriately beneficial flat curve course can be implemented at the start and end of the transport movement. The large-component transfer press or press line can be run without difficulty with phase-shifted ram positions, which results in a beneficial force distribution with a low drive power. This measure likewise increases the component output by reducing the transport times.

During the actual shaping operation, the articulated-arm transport system should be located in a lowered position in the upright area, as a result of which beneficial accessibility to the rising ram is provided for the following component transport. This accessibility permits an early inward movement and, as a result, in addition reduces the idle times. This lowered parking position is also made possible by superimposing the horizontal and the vertical movements.

Depending on the task set, it may be necessary for the attitude of the components to be changed between two shaping stations. In a press line, the attitude change takes place by means of intermediate stores, orientation stations as they are known. Since the intermediate stores lead to an enlargement of the overall press length, attempts are made to avoid this solution in the case of large-component transfer presses. When used in a large-component transfer press, if required, the articulated-arm transportation system is designed with an additional pivoting movement.

The installation position of the articulated-arm transport system is any desired, that is to say the pivoting movement can be carried out both above and below the transport plane.

Further details and advantages of the invention emerge from the following description of exemplary embodiments.

In the seven figures, in schematic form:

DESCRIPTION OF THE EXEMPLARY EMBODIMENTS

Figure 1:
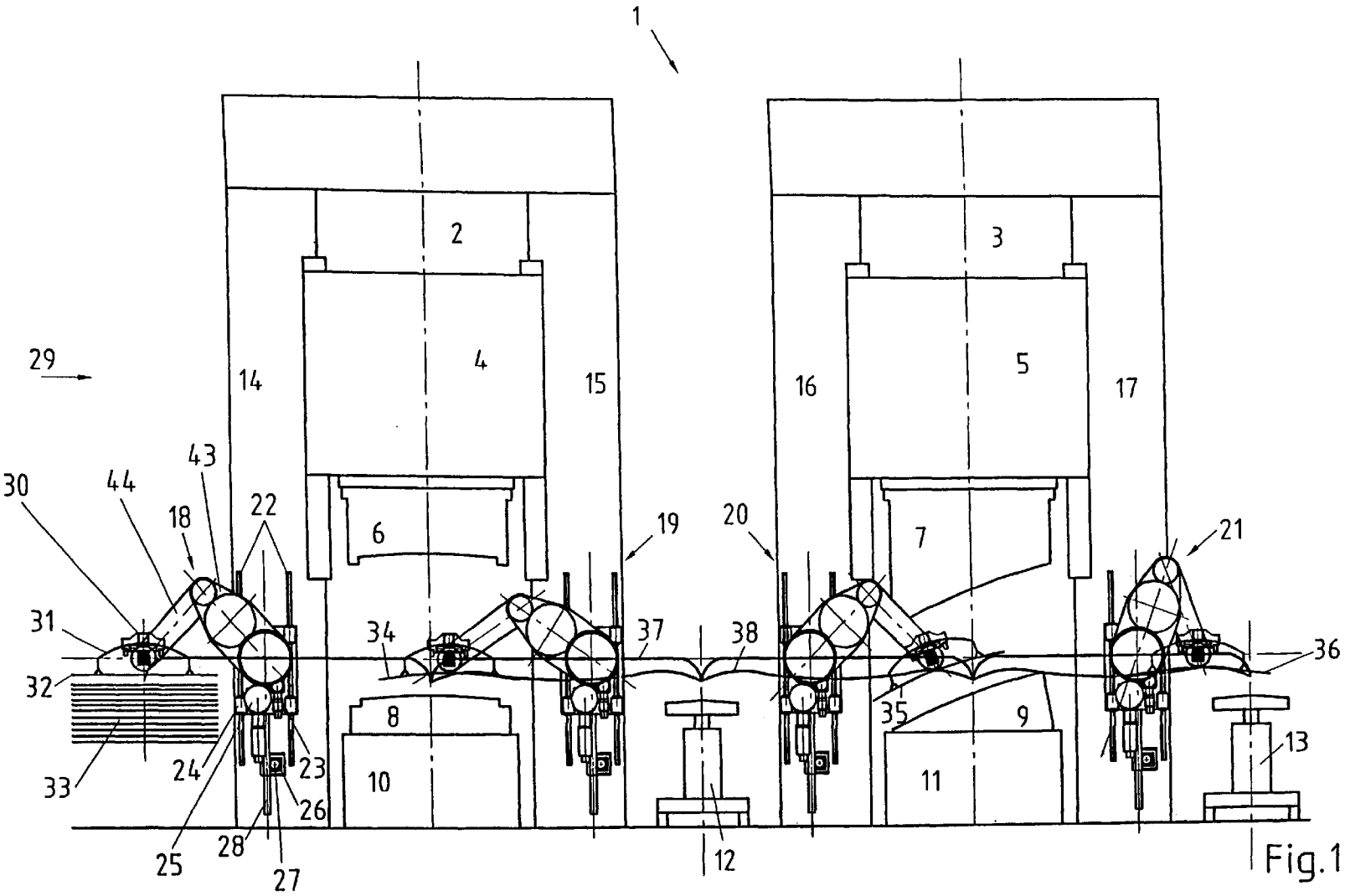
FIG. 1 shows a press line with an articulated-arm transport system

By way of example, presses 2 and 3 from a press line 1 are illustrated in FIG. 1. Press rams 4 and 5 carry upper tools 6 and 7. Lower tools 8 and 9 are located on sliding tables 10 and 11. Arranged between the presses are orientation stations 12 and 13. On the press uprights 14–17 there are the articulated-arm transport systems 18–21 according to the invention, in different functional positions. Vertical guide rails 22 are fixed to the press uprights 14–17, carriages 23 with guides 24 carry the articulated arms 43, 44. The drive motor for pivoting the arm is designated by 25. The stationary lifting motor 26 for the vertical movement is operatively connected via a gear 27 to a rack 28. More detailed constructional details will be described in following figures. The task of the articulated-arm transport system 18–21 is to convey components cyclically in the transport direction 29 through machining and orientation stations arranged one after another. The various movement sequences are not illustrated chronologically but by way of example.

In order to load the first press 2, the component holding means 31, for example suction spiders, fixed to transverse crossmember 36 [sic] and belonging to the articulated-arm transport system 18 pick up panels 32 from a panel stack 33. A shaped part 34 is removed from the opened press 2 by the articulated-arm transport system 19 and transported to the orientation station 12. Articulated-arm transport system 20 inserts a component 35, which has previously experienced an attitude change in the orientation station 12, into press 3. Articulated-arm transport system 21 in turn deposits a component 36 shaped in press 3 onto the orientation station 13. The travel curve for the component transport is identified by 37, that for the parking position by 38. In this application, pivoting of the components by the articulated-arm transport system is not provided and, if required, is carried out by the orientation stations 12, 13.

In each case the articulated-arm transport systems are arranged on the press uprights in pairs and opposite each other in mirror-image fashion. Pick-up elements for the transverse crossmember 30 carrying the component holding means 31 are configured in such a way that automatic replacement at a tool change is possible.

The shaping of the articulated arm, which is particularly beneficial in order to utilize the free accessibility between the upper and lower tools, can easily be seen. In addition, the travel curves 37, 38 clearly show the beneficial conditions for very flat insertion and removal of the parts. Superimposition of the vertical movement by means of the lifting drive 26 on the horizontal movement of the pivoting arm actuated by the drive motor 25 results in very advantageous movement sequences.

In addition, the proposed lowered parking position benefits early insertion into the tool clearance.

Figure 2:
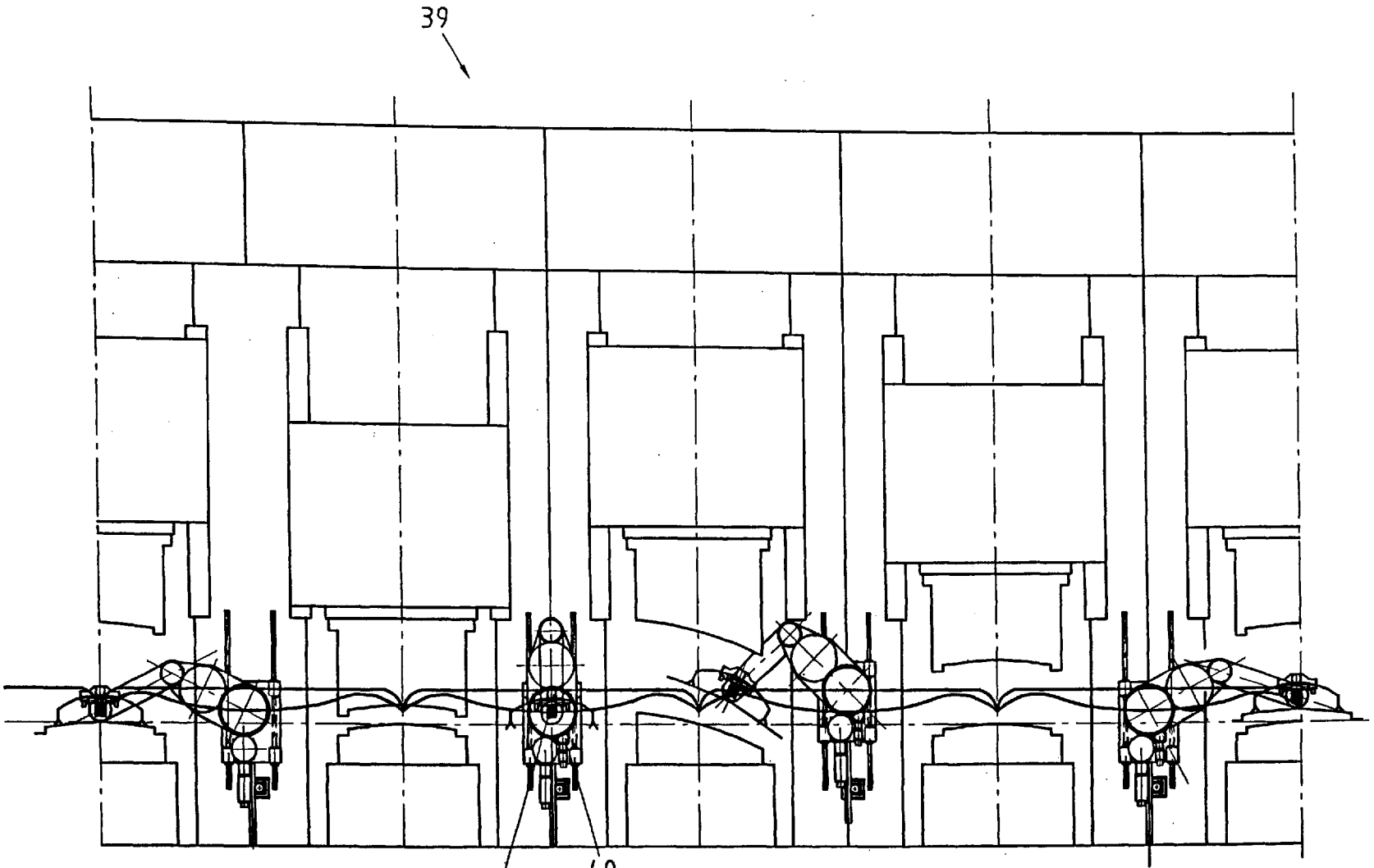
FIG. 2 shows a large-component transfer press with an articulated-arm transport system

FIG. 2 shows the arrangement of an articulated-arm transport system in a large-component transfer press 39. Illustrated by way of example are shaping stages in different movement sequences. In order to reduce the overall length of the press, intermediate stores or orientation stations have been omitted. If a change in the attitude of the component is necessary, this is carried out directly by the articulated-arm transport system. For this purpose, use is made of a drive 40, which is connected via drive elements to the transverse crossmember 30. The functional sequences are comparable with those already described under FIG. 1.

Figure 3A:
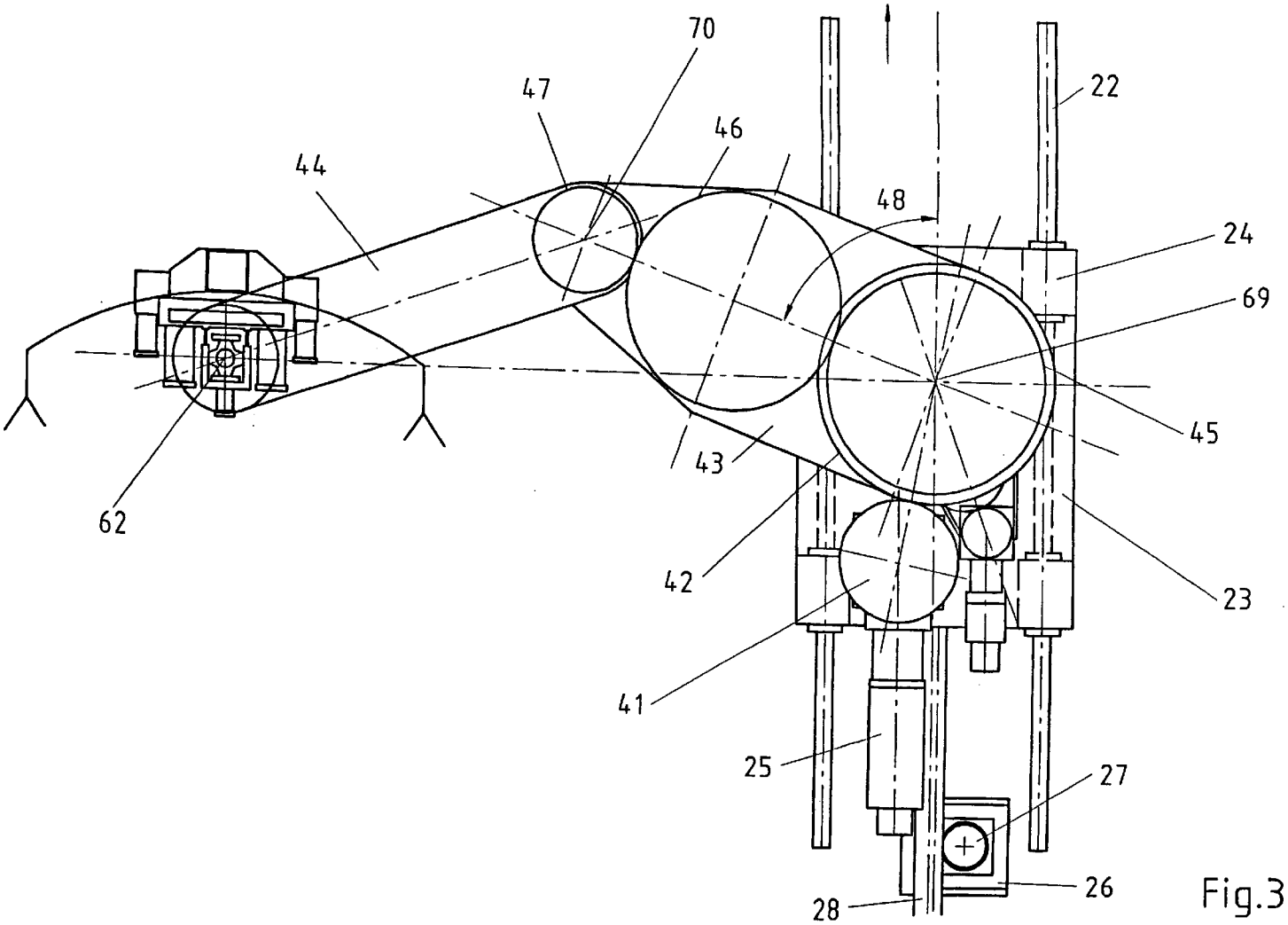
FIG. 3*a* shows a detail of the articulated arm drive
Figure 3B:
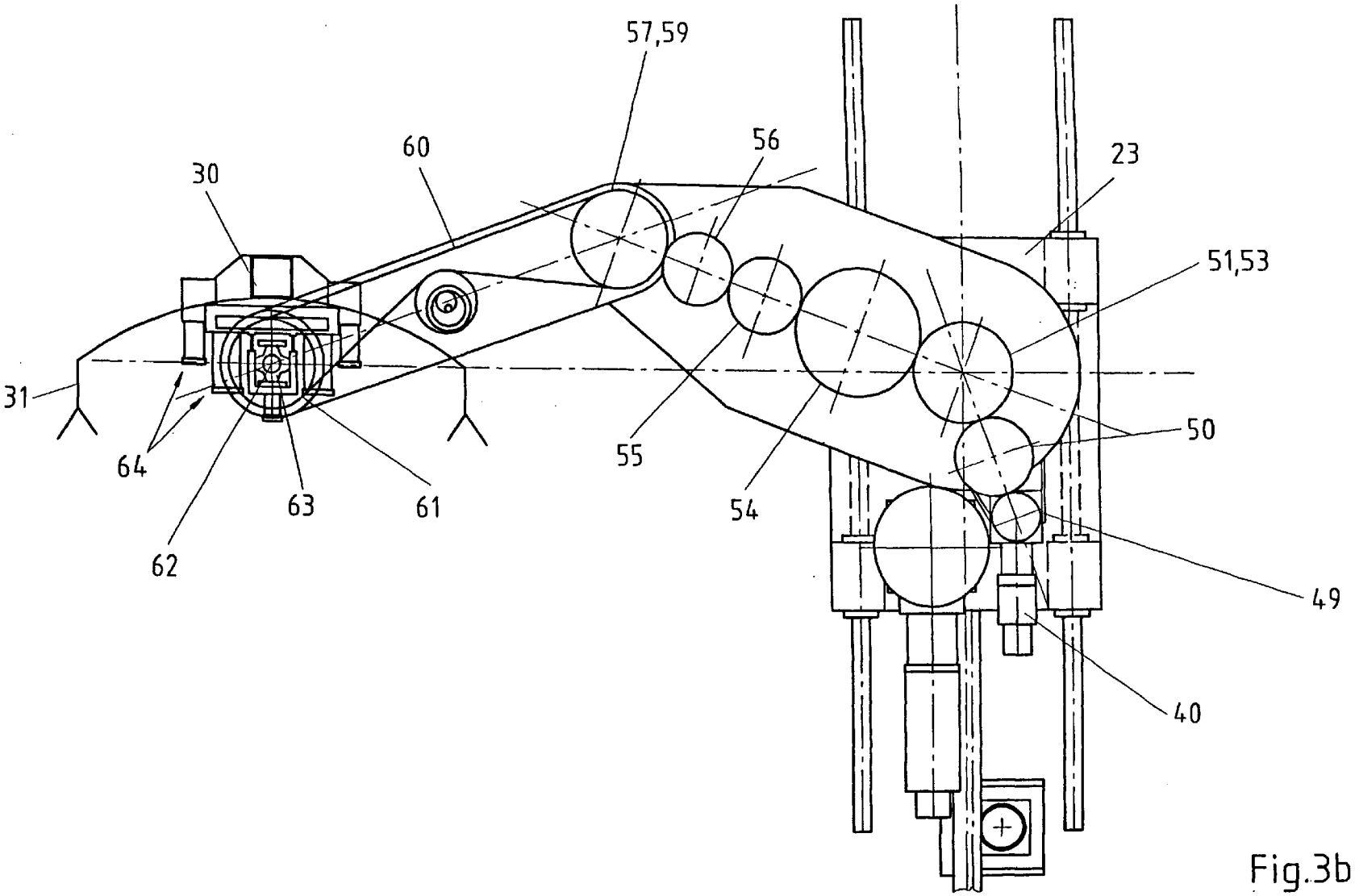
FIG. 3*b* shows an individual unit [sic] of pivoting the transverse crossmember drive

FIG. 3*a* and FIG. 3*b* show an articulated arm in enlarged form in front view. For the purpose of simplification and better clarification, the illustration has been selected such that the drive chain for the pivoting arm can be explained in FIG. 3*a*, and the drive for pivoting the transverse crossmember 30 can be explained in FIG. 3*b*. In addition, reference is made to FIG. 4 for an understanding of the function.

It is possible to see the vertical guide rails 22 and the carriage 23, which can be moved in guides 24 and carries the pivoting arm. The vertical movement is effected by the stationary lifting motor 26, which drives the gear 27 that is operatively connected to the rack 28. In order to pivot the articulated arm, according to FIG. 3*a* use is made of the drive motor 25, which drives gear 41. The gear 41 drives rack 42, which is permanently connected to the first pivoting-arm part 43. This connection effects the pivoting movement of the first pivoting-arm part 43 about the axis of rotation 69. A further drive train is used to pass on the pivoting movement from the first pivoting-arm part 43 to the second pivoting-arm part 44. For this purpose, there is a first gear 45 in the first pivoting-arm part 43. This gear 45 is permanently connected to the carriage 23. The gear 46 meshes with the gear 45, and the gear 47 meshes with said gear 46. The gear 47 is permanently connected to the second pivoting-arm part 44. If the pivoting movement of the first pivoting-arm part 43 is initiated by the drive motor 25 via gears 41, 42, then this movement produces a rolling pivoting movement of the gears 46, 47 and, as a result of the permanent connection to gear 47, the corresponding pivoting of the second pivoting-arm part 44 about the axis of rotation 70.

The magnitude of the pivoting movement or the pivoting angle 48 can be controlled continuously via the drive 25 which, for example, is designed as a controlled servomotor. It is easy to see that the greater the choice of pivoting angle 48, the more the articulated-arm system 43, 44 approaches the horizontal stretched attitude, and the smaller is the required clearance for the insertion or removal of the components. A distortion-free horizontal movement is achieved if, based on the axes of rotation or bearing axes 67, 70, 62, the two pivoting-arm parts 43, 44 are designed with the same length.

If a change in the attitude of the components during the transport step is required as a further movement, then this can be carried out in accordance with FIG. 3*b*. For this purpose, the pivoting drive 40 mounted on carriage 23 drives the gear 49. Via intermediate gear 50, the rotational movement is transmitted to gear 51. Gear 51 is connected to gear 53 via a common shaft 52. Gear 53 drives the gear train 54–57 mounted in the first pivoting-arm part 43. Gear 57 is permanently connected, via a hollow shaft 58, to toothed belt pulley 59 and drives the latter. Toothed belt pulley 59 drives toothed belt pulley 61 via toothed belt 60. Toothed belt pulley 61 forms a unit with the pick-up and bearing unit of the transverse crossmember 30 and effects a pivoting movement about the pivot axis 62. Since the pivoting drive 40 can also be a controlled servomotor, a defined change in the attitude of the components is ensured.

The pick-up and bearing unit for the transverse crossmember 30 is designed, for example, as a cardan joint 63, which also makes possible a horizontal and vertical oblique position of the transverse crossmember 30. Elements for the automatic change of the transverse crossmember 30 during a tool change are provided and designated by 64.

Figure 4:
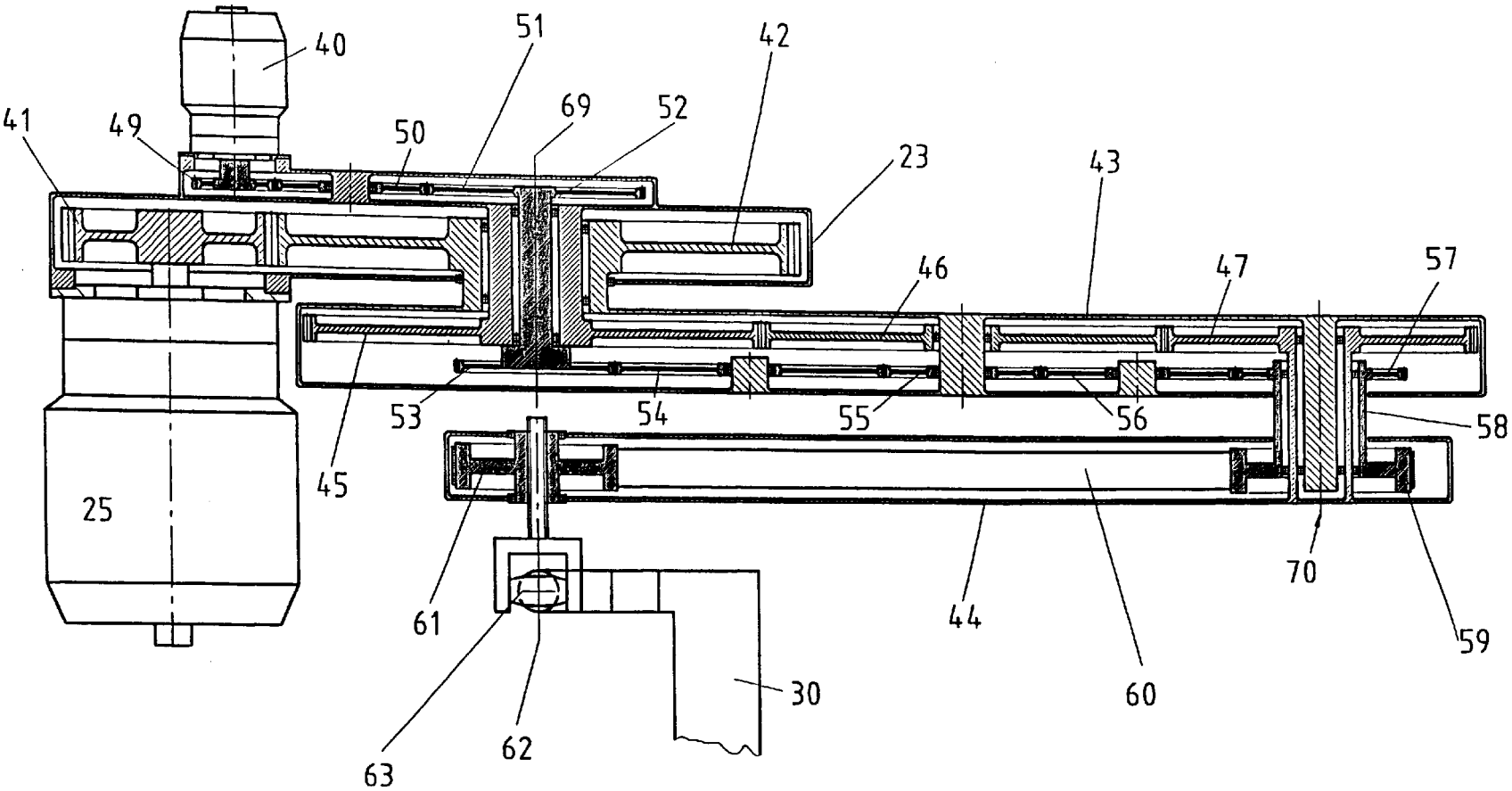
FIG. 4 shows a plan view of FIG. 3*a* and FIG. 3*b*

The drive chains described in FIGS. 3*a* and 3*b* can be seen together from the sectional illustration of FIG. 4. In addition to other constructional details, it is in particular possible to see the permanent connection of gear 45 to carriage 23, required for the pivoting of the first pivoting-arm part 43, and likewise the permanent connection of gear 47 to the second pivoting-arm part 44. Since the opening angle between the pivoting-arm parts 43, 44 is twice as great as that of the pivoting angle 48, the transmission ratio from gear 45 to gear 47 is accordingly also 2:1. The drive chain hatched more darkly in FIG. 4 is used to pivot the transverse crossmember 30 about the pivot axis 62.

Figure 5:
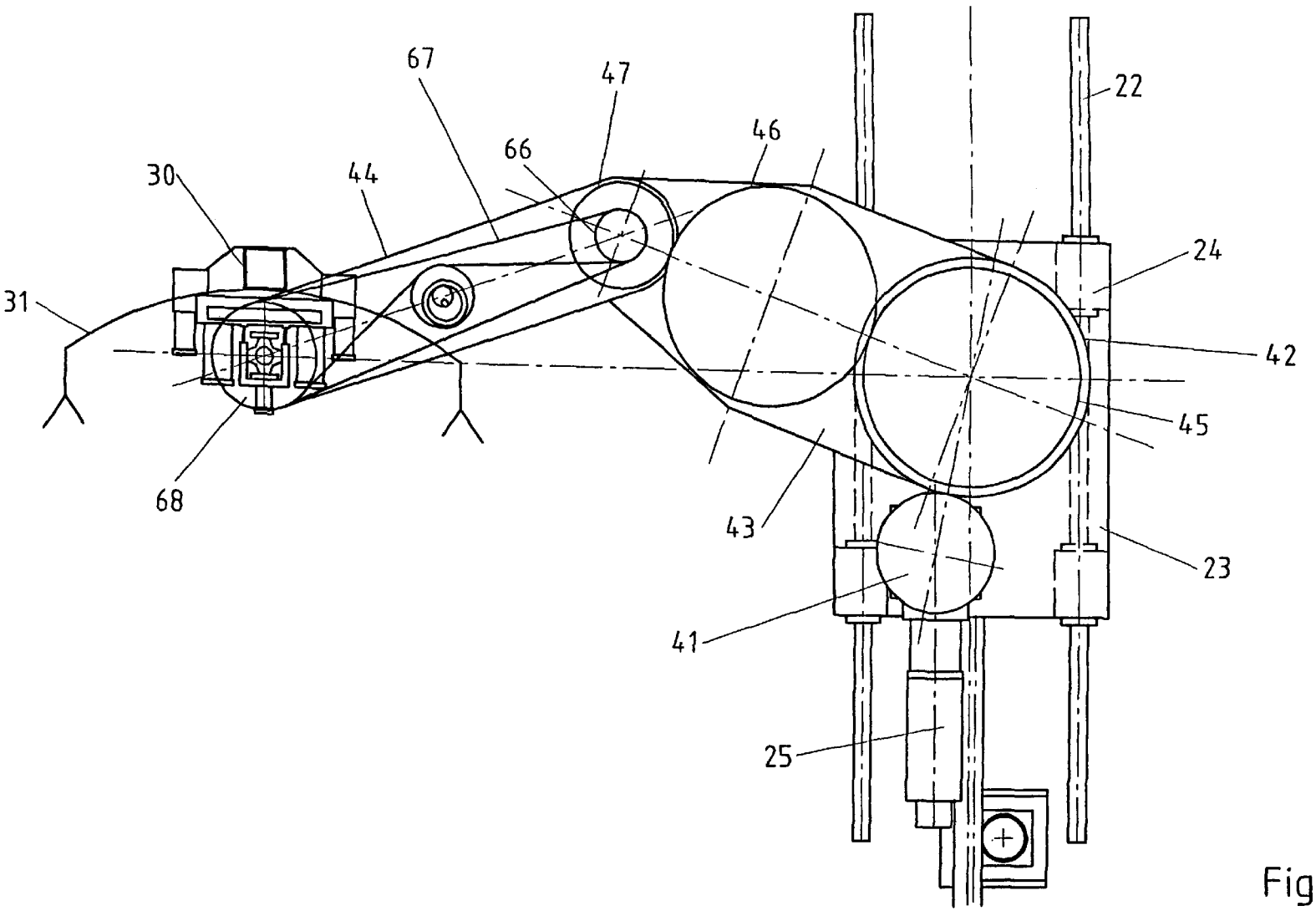
FIG. 5 shows a detail of pivoting the articulated arm without a transverse crossmember
Figure 6:
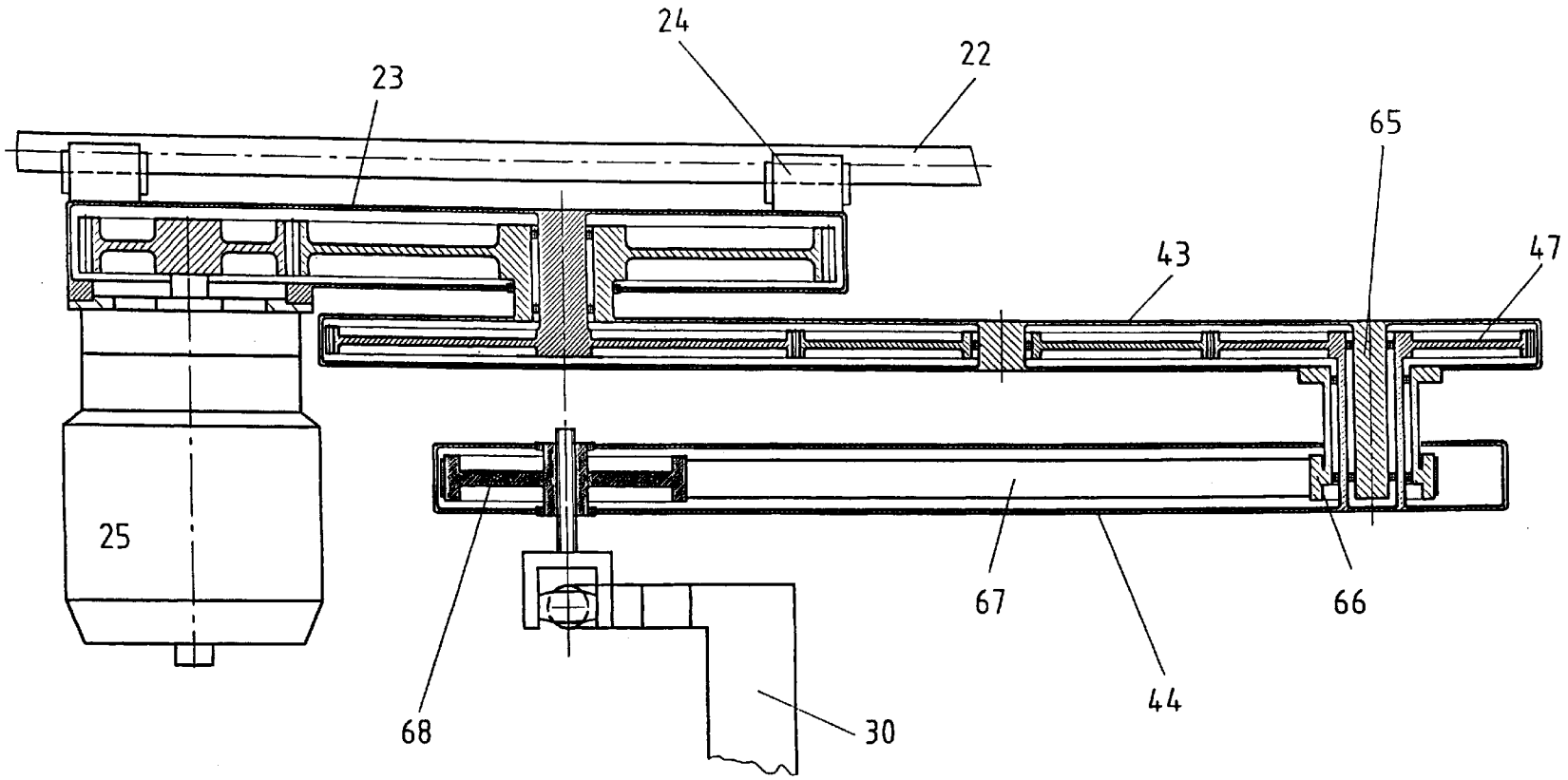
FIG. 6 shows a plan view of FIG. 5.

An embodiment without pivoting the transverse crossmember 30 is shown by FIGS. 5 and 6. The functional description of the vertical lifting movement and the gear arrangement in the carriage 23 and the first pivoting arm 43 can be taken from the previous figures. In addition, the connection of the first pivoting-arm part 43 to the second pivoting-arm part 44 via gear 47, and the moveable mounting of the arms is constructionally identical to the embodiment already described. New is the permanent connection of toothed belt pulley 66 to the first pivoting-arm part 43. The toothed belt drives 66, 67, 68 are now used to stabilize the transverse crossmember 30 and hold it in the correct attitude. The important factor here is that, given the selected arrangement and geometry, the belt pulley and therefore the transmission are therefore selected in the ratio 2:1, that is to say the belt pulley 68 has twice the diameter of the belt pulley 66. Given equal lengths of the pivoting-arm parts 44, 43, a satisfactory horizontal movement of transverse crossmember 30 and component holding means 31 is thus again ensured.

The invention is not restricted to the exemplary embodiments described and depicted. It also comprises all configurations by persons skilled in the art within the scope of the applicable claim 1. It is possible, for example, to change the horizontal transport movement into an oblique or diagonal movement. For this purpose, the gear 45 that is permanently connected to the carriage 23 is driven via a further gear with drive in such a way that a vertical movement is superimposed on the horizontal movement.

| | |
|---|---|
| 1 | Press line |
| 2 | Press |
| 3 | Press |
| 4 | Press ram |
| 5 | Press ram |
| 6 | Upper tool |
| 7 | Upper tool |
| 8 | Lower tool |
| 9 | Lower tool |
| 10 | Sliding table |
| 11 | Sliding table |
| 12 | Orientation station |
| 13 | Orientation station |
| 14 | Press upright |
| 15 | Press upright |
| 16 | Press upright |
| 17 | Press upright |
| 18 | Articulated-arm transport system |
| 19 | Articulated-arm transport system |
| 20 | Articulated-arm transport system |
| 21 | Articulated-arm transport system |
| 22 | Vertical guide rails |
| 23 | Carriage |
| 24 | Guides |
| 25 | Drive motor |
| 26 | Lifting motor |
| 27 | Gear |
| 28 | Rack |
| 29 | Transport direction |
| 30 | Transverse crossmember |
| 31 | Component holding means |
| 32 | Panel |
| 33 | Panel stack |
| 34 | Component |
| 35 | Component |
| 36 | Component |
| 37 | Component transport travel curve |
| 38 | Parking position travel curve |
| 39 | Large-component transfer press |
| 40 | Pivot drive |
| 41 | Gear |
| 42 | Gear |
| 43 | First pivoting-arm part |
| 44 | Second pivoting-arm part |
| 45 | Gear |
| 46 | Gear |
| 47 | Gear |
| 48 | Pivoting angle |
| 49 | Gear |
| 50 | Intermediate gear |
| 51 | Gear |
| 52 | Shaft |
| 53 | Gear |
| 54 | Gear |
| 55 | Gear |
| 56 | Gear |
| 57 | Gear |
| 58 | Hollow shaft |
| 59 | Toothed belt pulley |
| 60 | Toothed belt |

-continued

| | |
|---|---|
| 61 | Toothed belt pulley |
| 62 | Pivot axis |
| 63 | Cardan joint |
| 64 | Changing device |
| 65 | Mounting |
| 66 | Toothed belt pulley |
| 67 | Toothed belt |
| 68 | Toothed belt pulley |
| 69 | Axis of rotation |
| 70 | Axis of rotation |

What is claimed is:

1. A device for transporting workpieces in a press, press-line, large-component transfer press, or simulator, the device comprising:

a machining station having at least one independent transport device for transporting the workpieces and for carrying out two-axis transport movement, the at least one transport device comprising:

a pivoting arm, the pivoting arm including first and second pivoting arm parts mounted for movement in rotation, a first movement transmission means coupled to the first pivoting arm part, a drive motor for acting on the first movement transmission means and controlling a magnitude of a pivoting angle of the first pivoting arm part, a transverse crossmember having a component holding means, a pick-up and bearing unit arranged at one end of the second pivoting part for coupling the transverse crossmember to the second arm part, linear guides, a carriage coupled to the linear guides and mounting at least the pivoting arm, a second transmission movement means coupled to the carriage, and a stationary lifting motor for vertically moving the carriage via the second movement transmission means.

2. The device according to claim 1, wherein the first pivoting arm part is mounted for movement in rotation on the carriage.

3. The device according to claim 1, wherein the first pivoting arm part includes a mounting and the second pivoting arm part is rotatably mounted to the first pivoting arm part via the mounting.

4. The device according to claim 1, wherein the first pivoting arm part is associated with first and second axes of rotation and the second pivoting arm part is associated with the second axis of rotation and a third axis of rotation, and wherein the first and second axes of rotation and the second and third axes of rotation are equally spaced apart.

5. The device according to claim 1, further comprising a gear permanently connected to the carriage.

6. The device according to claim 1, wherein the device further includes first and second gears having a two-to-one transmission ratio, and wherein the first pivoting-arm part, in conjunction with the first movement transmission means, effects the pivoting of the second pivoting-arm part about an axis of rotation.

7. The device according to claim 1, wherein the pick-up and bearing unit comprises a cardan joint and a changing device and the transverse crossmember is connected to cardan joint via the changing device.

8. The device according to claim 1, wherein the device further includes a pivoting motor fixed to the carriage and the transverse crossmember is pivotable about a pivot axis and the first movement transmission means, and the pivoting angle is selectable by controlling the drive motor.

9. The device according to claim 1, wherein the transverse crossmember includes a changing device and the pivoting arm includes a toothed belt, a first toothed-belt pulley mounted to a free end of the second pivoting arm part, and a second toothed-belt pulley permanently connected to the first pivoting arm part, and wherein the second toothed-belt pulley is arranged in the second pivoting arm part and connected to the changing device via the toothed belt and the first toothed-belt pulley.

10. The device according to claim 9, wherein the first toothed-belt pulley and the second toothed-belt pulley have a two-to-one transmission ratio.

* * * * *